US009111499B2

(12) United States Patent
Oohira

(10) Patent No.: US 9,111,499 B2
(45) Date of Patent: Aug. 18, 2015

(54) LIQUID CRYSTAL DISPLAY DEVICE

(71) Applicant: Japan Display Inc., Tokyo (JP)

(72) Inventor: Tomohide Oohira, Tokyo (JP)

(73) Assignee: JAPAN DISPLAY INC., Tokyo (JP)

( * ) Notice: Subject to any disclaimer, the term of this patent is extended or adjusted under 35 U.S.C. 154(b) by 13 days.

(21) Appl. No.: 14/047,199

(22) Filed: Oct. 7, 2013

(65) Prior Publication Data

US 2014/0104256 A1 Apr. 17, 2014

(30) Foreign Application Priority Data

Oct. 11, 2012 (JP) ..... 2012-225967

(51) Int. Cl.
*G09G 3/36* (2006.01)

(52) U.S. Cl.
CPC ..... *G09G 3/3614* (2013.01); *G09G 2320/0223* (2013.01); *G09G 2320/0252* (2013.01)

(58) Field of Classification Search
CPC . G09G 3/3688; G09G 3/3677; G09G 3/3614; G09G 2300/0823
USPC ..... 345/87, 95, 96, 98–100, 209
See application file for complete search history.

(56) References Cited

U.S. PATENT DOCUMENTS

| | | | | |
|---|---|---|---|---|
| 6,980,190 | B2 | 12/2005 | Ueda | |
| 7,580,018 | B2 * | 8/2009 | Takeda et al. | 345/87 |
| 8,232,942 | B2 * | 7/2012 | Hashimoto | 345/87 |
| 2004/0150612 | A1 * | 8/2004 | Okuzono et al. | 345/100 |
| 2005/0083319 | A1 * | 4/2005 | Kodate et al. | 345/204 |
| 2005/0212783 | A1 * | 9/2005 | Kasai et al. | 345/204 |
| 2006/0279506 | A1 * | 12/2006 | Choi | 345/98 |
| 2010/0066708 | A1 * | 3/2010 | Kim et al. | 345/204 |

FOREIGN PATENT DOCUMENTS

JP 2009-15334 1/2009

* cited by examiner

*Primary Examiner* — Ricardo L Osorio
(74) *Attorney, Agent, or Firm* — Lowe Hauptman & Ham, LLP

(57) ABSTRACT

In a liquid crystal display device that performs two-line inversion driving, a difference of a write period of a substantial video signal between a pair of pixel rows scanned with the same polarity is compensated. An input signal pre-processing circuit 42 receives display data DATA and an original data enable signal DTMG, generates and inputs a data enable signal DTMG_R and display data DATA_R to a driver control signal generation block 40. DTMG_R is reduced in the active period, and an interval of the active period between a (2n−1)-th row and a 2n-th row is set to be larger than an interval of the active period between the 2n-th row and a (2n+1)-th row. The input signal pre-processing circuit 42 reads out DATA of each row from a buffer as DATA_R in an active period of DTMG_R.

9 Claims, 9 Drawing Sheets

PRIOR ART

LIQUID CRYSTAL DISPLAY DEVICE

CROSS-REFERENCE TO RELATED APPLICATION

The present application claims priority from Japanese application JP2012-225967 filed on Oct. 11, 2012, the content of which is hereby incorporated by reference into this application.

BACKGROUND OF THE INVENTION

1. Field of the Invention

The present invention relates to a liquid crystal display device, and more particularly to a technique effective in driving for inverting a polarity of video signals to be applied to pixels every two rows.

2. Description of the Related Art(s)

The liquid crystal display device includes a liquid crystal display panel having a liquid crystal material sealed between two substrates, and a driver circuit that drives the liquid crystal display panel. In a display region of the liquid crystal display panel, pixels each having a pixel electrode and a common electrode are arranged in a matrix having a horizontal direction as a row direction, and a vertical direction as a column direction. The pixel electrode in each of the pixels is set to a voltage corresponding to display data, and each of the pixel expresses a gradation according to an orientation of liquid crystal molecules which are controlled by a potential difference between the pixel electrode and the common electrode.

The liquid crystal display panel of an active matrix system includes scanning signal lines disposed for respective pixel rows, video signal lines disposed for respective pixel columns, and active elements for the respective pixels. The active elements are, for example, thin film transistors (TFTs), and each of the TFTs has a gate connected to one of the scanning signal lines, a drain connected to one of the video signal lines, and a source connected to one of pixel electrodes.

The liquid crystal display panel is early deteriorated if the liquid crystal display panel is driven by a DC current. In order to suppress the deterioration, an AC voltage driving that periodically inverses a polarity of a voltage between the pixel electrode and the common electrode is conducted. The polarity is set to be positive if a potential of a gradation voltage (video signal) to be applied to the pixel electrode is higher than a potential of a common voltage to be applied to the common electrode, and set to be negative if the potential of the gradation voltage is lower than the potential of the common potential.

As the AC voltage driving, there are a row line inversion driving system and a dot inversion driving system. In the row line inversion driving system, a plurality of pixel rows configuring an image of one frame is set to be alternately positive and negative, and in the dot inversion driving system, the plurality of pixels arranged in a matrix is set to be alternately positive and negative in each of the row direction and the column direction. In the AC voltage driving, for example, the video signal lines are charged or discharged with the inversion of the polarity to increase a power consumption. The power consumption associated with the charge and discharge operation basically becomes larger as a drive voltage is larger, and also as an inversion frequency is higher. For that reason, in the display device having the liquid crystal display panel of a high resolution, the inversion frequency is lowered as N-line (row) inversion driving that inverts the polarity every N rows ($N \geq 2$), and the power consumption can be reduced.

FIG. 8 is a block diagram of a display control circuit that controls the drive of the liquid crystal display panel. A display control circuit (ICON) 2 receives display data DATA, a display timing signal DTMG, and a dot clock signal DCLK from an image signal source outside the liquid crystal display device. A driver control signal generation block 4 within the display control circuit 2 controls the drive of the liquid crystal display panel on the basis of those input signals. A drain driver (video signal line driver circuit) receives display data DATA_A, a reference clock CL2, a start pulse STH, a data latch pulse CL1, and an AC signal M among the signals output from the driver control signal generation block 4. A gate driver (scanning signal line driver circuit) receives a gate start pulse FLM and a gate shift clock CL3.

FIG. 9 is a timing chart of input/output signals of the display control circuit 2, and potentials of drain signal lines (video signal lines) and gate signal lines (scanning signal lines). In FIG. 9, DCLK and CL2 are omitted. DTMG denotes a data enable signal, and indicates a valid period (active period) of the display data input. DTMG is H (high) level in the active period, and in this example, a width of the active period provided for each horizontal scanning period (1H) is represented by $\tau_{DE}$. DATA_T is identical with DATA from the external, and DATA input by serial transmission in synchronization with DCLK from the external during the active period is written into a latch circuit of the drain driver in synchronization with CL2. CL2 has the same frequency as that of DCLK, and a write period of display data for one row into the latch circuit is $\tau_{DE}$. CL1 is generated in synchronization with a timing of write completion into the latch circuit in the 1H period, and the drain driver converts the display data for one row, which is held in the latch circuit, into a video signal in synchronization with CL1, and supplies the video signal to a group of drain signal lines. FIG. 9 illustrates two-line inversion driving, and converts video signals on a (2n−1) row and a 2n row (n is a natural number) into video signals having the same polarity. The video signal on each row is supplied to each drain signal line every 1H period, and a TFT of a corresponding row turns on by a gate pulse (scanning signal) which is applied to the gate signal line, to write the video signal into the pixel electrode.

SUMMARY OF THE INVENTION

In the line (row) inversion driving, it takes time until a voltage across the video signal line immediately after the polarization inversion arrives at the voltage of the video signal output from the drain driver, which is attributable to a capacity or a resistance of the video signal line. A delay of rising of the video signal on the video signal lines causes a substantially write time of a first row immediately after the polarity inversion to be shorter than that of a following row. In particular, as the write period of the video signal per row is made shorter with an increase in the number of horizontal scanning lines in one frame by the higher resolution, a rate of a rising delay time of the video signal immediately after the polarity inversion to the write period of the row immediately after the inversion is increased more. Therefore, a difference in the effective write period of the video signal between the row immediately after the inversion and the following row becomes remarkable. For that reason, if N-line (for example, 2 lines) inversion driving is employed in the liquid crystal display device with the high resolution, for example, when the same color is displayed over the overall screen with the same gradation, there arises such a problem that a lateral stripe appears on a display screen every N rows, and an image quality is degraded.

To cope with this problem, there is a technique in which a precharge voltage is output to the video signal lines in a head of the write period to accelerate a rising of the voltage, and an influence of the above delay time is reduced (JP 2009-15334 A). However, there arises such a problem that the image quality is not always sufficiently improved by only the above technique as the write period becomes shorter by the higher resolution.

The present invention has been made to solve the above problem, and therefore aims at providing a liquid crystal display device that eliminates or reduces the lateral stripe on the image, which is attributable to a difference in the substantial write period of the video signal between a pair of pixel rows scanned with the same polarity by the two-line inversion driving to improve the image quality.

(1) According to one aspect of the present invention, there is provided a liquid crystal display device, including: a plurality of pixels which is arranged in a matrix; a plurality of video signal lines which is provided in correspondence with a plurality of pixel columns, and supplies video signals to the pixels; a plurality of scanning signal lines which is provided in correspondence with a plurality of pixel rows, and is supplied in turn with scanning signals for selecting a scanning row to which the video signals are supplied among the pixel rows; a video signal line driver circuit into which display data corresponding to one of the pixel rows is written, and which generates the video signal on the basis of the display data and outputs the video signals to the plurality of video signal lines in parallel when an output timing signal is input to the video signal line driver circuit; and a display control circuit that receives the display data from an external by serial transmission, outputs the display data and the output timing signal to the video signal line driver circuit, and performs line inversion driving of the pixels every two rows, in which the display control circuit writes the display data into the video signal line driver circuit on at least a preceding scanning row of a pair of the pixel rows which are adjacent to each other and supplied with the video signals of the same polarity, at a speed higher than a transmission speed from the external, and sets an output period of the video signals on the preceding scanning row to be longer than an output period of the video signals on a following pixel row of the preceding scanning row, the output period for each of the pixel rows being determined according to a cycle of the output timing signal.

(2) According to another aspect of the present invention, there is provided a liquid crystal display device, including: a control signal generator circuit that receives display data corresponding to a plurality of pixels arranged in a matrix, and a data enable signal which is rendered active in a valid data period of each of pixel rows, conducts a drive control for writing video signals corresponding to the display data into the respective pixels in synchronization with the data enable signal, and performs line inversion driving of the pixels every two rows; a video signal line driver circuit into which the display data corresponding to one of the pixel rows is written in an active period of the data enable signal under the drive control, and which generates the video signals on the basis of the display data, and outputs the video signals to a plurality of video signal lines provided in correspondence with a plurality of pixel columns in parallel; and an input signal pre-processing circuit that receives the display data and an original data enable signal from an external of the liquid crystal display device, generates a modified data enable signal having an active period reduced more than an active period of the original data enable signal, and inputs the modified data enable signal to the control signal generator circuit as the data enable signal, the input signal pre-processing circuit, in the active period of the modified data enable signal, reading out the display data of the respective pixel rows stored in a buffer at a speed higher than that when being input from the external and inputting the display data to the control signal generator circuit, in which the modified data enable signal has an interval of the active period between a preceding scanning row and a following scanning row, which are a pair of the pixel rows adjacent to each other and supplied with the video signals of the same polarity set to be larger than an interval of the active period between the following scanning row and a row subsequent to the following scanning row.

(3) In the liquid crystal display device according to the item (2), the input signal pre-processing circuit includes two memory banks as the buffer, each of which can store the display data of the pair of pixel rows, sequentially writes the display data of the pair of pixel rows, which are adjacent to each other and supplied with the video signals of the same polarity, in the memory banks in synchronization with the original data enable signal, and reads out the display data written into one of the memory banks in synchronization with the modified data enable signal, and inputs the display data to the control signal generator circuit, while writing the display data into the other memory bank.

(4) In the liquid crystal display device according to the item (2), the input signal pre-processing circuit sets an interval of an active period of the modified data enable signal between the preceding scanning row and the following scanning row to a period obtained by adding an extension period to a horizontal scanning period given in a cycle of the original data enable signal, for each of a pixel row pair which is adjacent to each other and supplied with the video signal of the same polarity, and increases the extension period according to a distance of the video signal line between the video signal line driver circuit and the preceding scanning row.

DETAILED DESCRIPTION OF THE INVENTION

Hereinafter, an embodiment of the present invention will be described with reference to the accompanying drawings.

Figure 1:
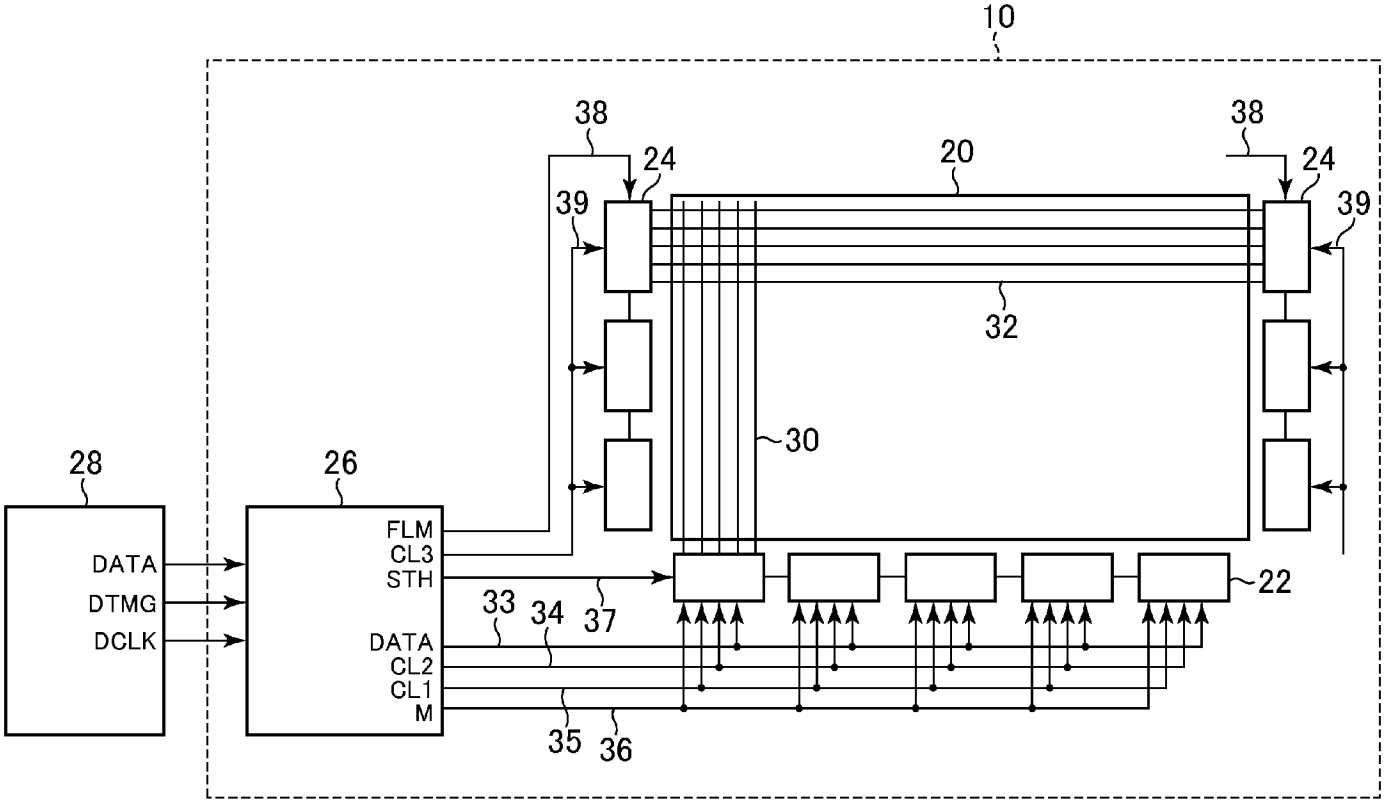
FIG. 1 is a schematic diagram illustrating a configuration of a liquid crystal display device according to an embodiment of the present invention.

FIG. 1 is a schematic diagram illustrating a configuration of a liquid crystal display device 10 according to an embodiment. The liquid crystal display device 10 includes a liquid crystal panel 20, drain drivers 22, gate drivers 24, a display control circuit (TCON) 26, a variety of power supply circuits (not shown), a backlight unit (not shown), and a backlight driver circuit (not shown).

The liquid crystal display device 10 is of an active matrix drive system. The liquid crystal panel 20 includes a color filter substrate and a TFT substrate which are arranged to face each other with a gap therebetween, and the gap between the color filter substrate and the TFT substrate is filled with liquid crystal. Polarizing films are stuck onto outer surfaces of the respective glass substrates configuring the color filter substrate and the TFT substrate. The TFT substrate is located on a back surface side of the liquid crystal panel 20, and the backlight unit is arranged at the rear of the liquid crystal panel 20. On the other hand, the color filter substrate is located on a display surface side of the liquid crystal panel 20.

On a surface of a liquid crystal side of the TFT substrate are formed with TFTs, pixel electrodes, a common electrode, and lines extended to those electrodes. Specifically, the pixel electrodes and the TFTs are each arranged in a matrix in correspondence with a pixel arrangement. The common electrode made of a transparent electrode material as with the pixel electrodes is also arranged in each of the pixels. As lines, a plurality of drain signal lines 30, a plurality of gate signal lines 32, and a common electrode line are formed. The plurality of drain signal lines 30 and the plurality of gate signal lines 32 are arranged to be substantially orthogonal to each other. The gate signal line 32 is disposed for each of the rows (alignment in a horizontal direction) of the TFTs, and commonly connected to the gate electrodes of a plurality of TFTs on the corresponding row. The drain signal line 30 is disposed in each column (alignment in a vertical direction) of the TFTs, and commonly connected to drains of the plurality of TFTs on the corresponding column. The source of each TFT is connected with a pixel electrode corresponding to the TFT.

The TFT disposed in each of the pixels as an active element (switch element) has an n-channel in this embodiment. The plurality of TFTs are supplied with gate pulses rising in a positive direction from the gate signal lines 32, and turn on a row basis. The pixel electrodes are connected to the drain signal lines 30 through the TFTs which have been turned on, and applied with signal voltages (pixel voltages) corresponding to display data from the drain signal lines 30. The common electrode is applied with a given common potential through the common electrode line. The liquid crystal is controlled in orientation for each of the pixels by an electric field developed according to a voltage between the pixel electrodes and the common electrode, and a transmittance of the liquid crystal to a light input from the backlight unit is changed to form an image on a display surface.

The drain signal lines 30 are connected to the drain drivers 22. The gate signal lines 32 are connected to the gate drivers 24. Each of the drain drivers 22 and the gate drivers 24 is formed of one semiconductor integrated circuit (IC). Since the liquid crystal panel 20 of this embodiment is high in resolution, and the numbers of drain signal lines 30 and gate signal lines 32 are large, the drain drivers 22 and the gate drivers 24 are each provided in plurality. Specifically, the plurality of drain drivers 22 are arrayed, for example, along an upper side of the liquid crystal panel 20. The drain signal lines 30 of the overall liquid crystal panel 20 are divided into a plurality of groups according to a position in a horizontal direction, and the drain signal lines 30 of each group are connected to one drain driver 22. The gate drivers 24 are arrayed in plurality along right and left sides of the liquid crystal panel 20. The gate signal lines 32 of the overall liquid crystal panel 20 are divided into a plurality of groups according to a position in a vertical direction, and right and left ends of the gate signal lines 32 in each of the groups are connected to one gate drivers 24 on the right and left sides, respectively. The gate drivers 24 can be configured to be arrayed on only any one of the right and left sides of the liquid crystal panel 20.

The display control circuit 26 receives display data DATA, a display timing signal DTMG, and a dot clock signal DCLK from an image signal source 28 outside of the liquid crystal display device 10. The image signal source 28 is formed of, for example, a computer, a personal computer, or a television receiver circuit. The display control circuit 26 controls the drive of the liquid crystal display panel on the basis of an input signal. Specifically, the display control circuit 26 supplies the display data DATA, a clock CL2, a data latch pulse CL1, and an AC signal M to the respective drain drivers 22 through signal lines 33 to 36. Also, the display control circuit 26 inputs a start pulse STH to a head of the plurality of drain drivers 22 aligned in the horizontal direction through a signal line 37. When write of the display data into a k-th (k is a natural number) drain driver 22 from the head has been completed, the start pulse STH is input to a (k+1)-th drain driver 22 from the k-th drain driver 22. Further, the display control circuit 26 supplies agate start pulse FLM and a gate shift clock CL3 through signal lines 38 and 39. Also, the display control circuit 26 generates a timing signal for controlling the backlight driver circuit.

Figure 2:
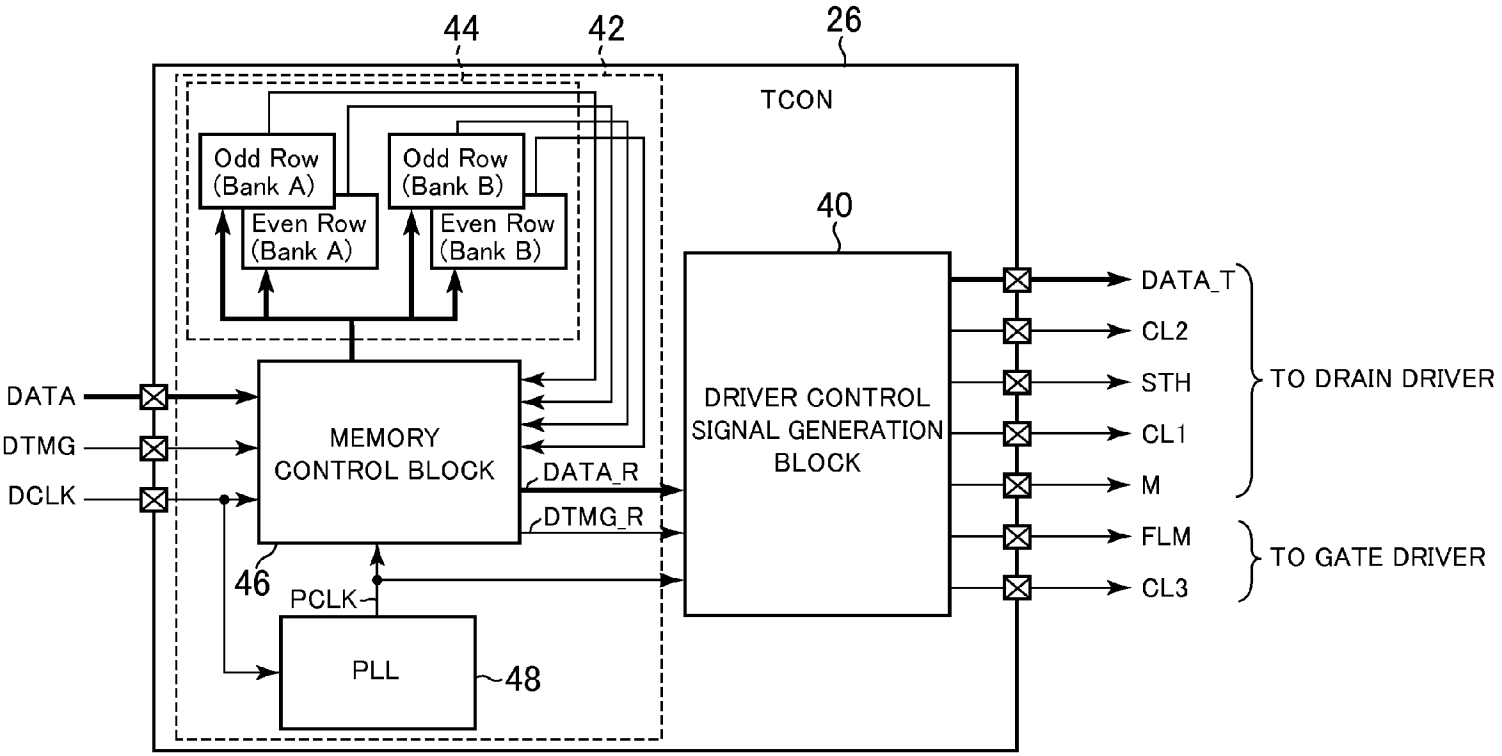
FIG. 2 is a block diagram illustrating a general configuration of a display control circuit provided in the liquid crystal display device according to the embodiment of the present invention.

FIG. 2 is a block diagram illustrating a general configuration of the display control circuit 26. The display control circuit 26 has a driver control signal generation block 40 and an input signal pre-processing circuit 42 that conducts pre-processing to be described later on an input signal from the external, and supplies the input signal to the driver control signal generation block 40.

As with a related-art driver control signal generation block 4, the driver control signal generation block 40 is a control signal generator circuit that receives the display data and the display timing signal (data enable signal), conducts a drive control for writing video signals corresponding to the display data into the respective pixels in synchronization with the display timing signal, and drives the line inversion of the pixels every two rows.

The input signal pre-processing circuit 42 receives the display data DATA and the display timing signal DTMG (original data enable signal) together with the clock signal DCLK from the image signal source 28. The input signal pre-processing circuit 42 subjects DATA, which is a digital signal transmitted in serial from the image signal source 28, to alteration of a transmission speed and an output timing to generate new display data DATA_R. Also, the input signal pre-processing circuit 42 generates a new display timing signal DTMG_R (modified data enable signal) having an active period set according to a valid period of the DATA_R. Then, the input signal pre-processing circuit 42 inputs those signals DATA_R and DTMG_R to the driver control signal generation block 40 instead of the original DATA and DTMG.

The input signal pre-processing circuit 42 receives the display data DATA and the display timing signal DTMG (original data enable signal) together with the clock DCLK from the image signal source 28. The input signal pre-processing circuit 42 subjects the DTMG from the image signal source 28 to the alternation of the timing to generate a new display timing signal DTMG_R (modified data enable signal), and inputs the DTMG_R to the driver control signal generation block 40 instead of the original DTMG.

In DTMG_R, a cycle of every two rows is identical with a cycle of the original DTMG, and the active period is made shorter than that of DTMG. Further, in DTMG_R, an interval in the active period between a preceding scanning row and a following scanning row, which are a pair of pixel rows adjacent to each other and applied with the video signals of the same polarity, is set to be larger than an interval in the active period between the following scanning row and a row subsequent to the following scanning row. In this embodiment, a (2n−1)-th row which is an odd row, and a 2n-th row which is an even row are driven with the same polarity, and a time difference $\zeta_O$ between the active period of the (2n−1)-th row and the active period of the 2n-th row is set to be larger than a time difference $\zeta_E$ between the active period of the 2n-th row and the active period of the (2n+1)-th row.

In order to shorten the active period of DTMG_R, the input signal pre-processing circuit 42 reads out the display data DATA of the respective pixel rows stored in the buffer at a speed higher than that when receiving the display data from the image signal source 28, and inputs the data to the driver control signal generation block 40.

The input signal pre-processing circuit 42 includes a memory block 44, a memory control block 46, and a phase locked loop (PLL) 48. The memory block 44 is a buffer that compensates a difference between a transmission speed of the display data DATA from the image signal source 28, and a transmission speed of the display data DATA to the driver control signal generation block 40, and includes two memory banks A and B each of which can store the display data for two rows therein.

The PLL 48 generates a clock signal PLCK higher in frequency than DCLK using DCLK as a reference signal, and supplies the clock signal PLCK to the memory control block 46 and the driver control signal generation block 40.

The memory control block 46 sequentially writes the display data of each row into the two memory banks in synchronization with DTMG. The memory control block 46 writes the display data of the odd row and the even row, which are adjacent to each other and applied with the video signals of the same polarity, into the memory bank alternately selected between the two memory banks. For example, the memory control block 46 writes a first row and a second row into the bank A, writes a third row and a fourth row into the bank B, and writes a fifth row and a sixth row into the bank A. While writing the display data into one memory bank, the memory control block 46 reads out the display data written into the other memory bank in advance to generate DATA_R, and inputs DATA_R to the driver control signal generation block 40.

Figure 3:
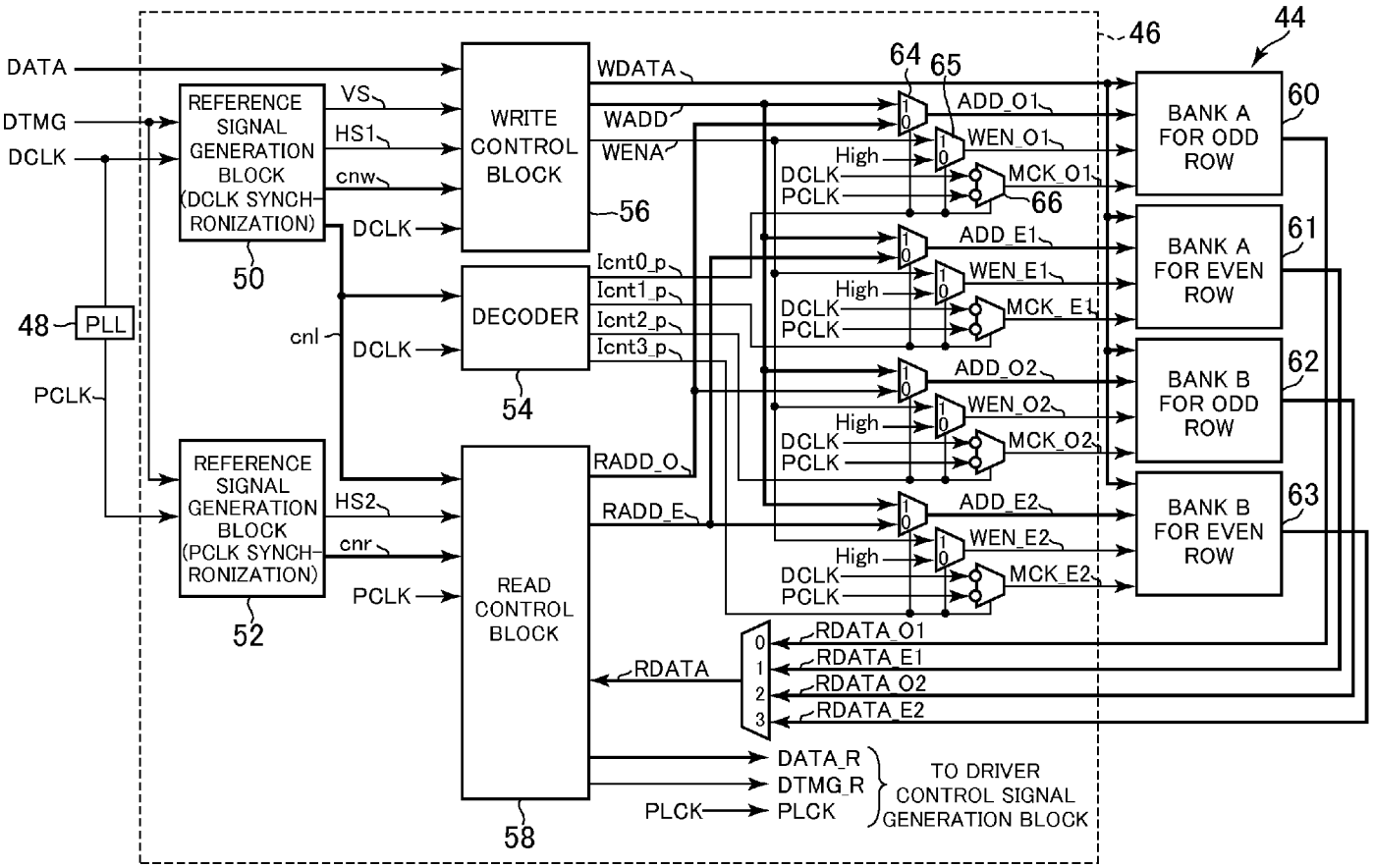
FIG. 3 is a block diagram illustrating a configuration of an input signal pre-processing circuit.

FIG. 3 is a block diagram illustrating a configuration of the input signal pre-processing circuit 42, which illustrates a configuration example of the memory control block 46. The memory control block 46 includes a reference signal generation block 50 that generates a reference signal in synchronization with DCLK, a reference signal generation block 52 that generates a reference signal in synchronization with PCLK, a decoder 54, a write control block 56, and a read control block 58.

The reference signal generation block 50 generates a vertical reference signal VS and a horizontal reference signal HS1 with reference to a rising edge of DTMG. A pulse of the vertical reference signal VS is generated in synchronization with a start timing of the active period corresponding to a head row of the respective frames. A pulse of the horizontal reference signal HS1 is generated in synchronization with a start timing of the respective active periods.

Also, the reference signal generation block 50 includes a write reference counter that is cleared in synchronization with the pulse of the horizontal reference signal HS1, and counts the clock number of DCLK, and a line counter that is cleared in synchronization with the pulse of the vertical reference signal VS, and counts the pulses of the horizontal reference signal HS1. The write reference counter has the number of bits that can be counted over the 1H period. The line counter has two bits, and a count value cnl repeats 0 to 3 within one frame.

On the other hand, the reference signal generation block synchronizes DTMG with PCLK, and generates a horizontal reference signal HS2. A pulse of the horizontal reference signal HS2 is generated with reference to a start timing of the respective active periods of DTMG.

Also, the reference signal generation block 52 has a read reference counter that is cleared in synchronization with the pulse of the horizontal reference signal HS2, and counts the clock number of PCLK. The read reference counter has the number of bits that can be counted over the 1H period.

The decoder 54 outputs a decoded result of the line counter. Specifically, the decoder 54 operates in synchronization with DCLK, receives a line counter value cnl from the reference signal generation block 50, and generates outputs lcnt0_p, lcnt1_p, lcnt2_p, and lcnt3_p. The lcnt0_p is set to an H level in a period where the line counter value cnl is 0, and set to a L (low) level in the other periods. Likewise, lcnt1_p, lcnt2_p, and lcnt3_p are selectively set to the H level in a period where the respective line counter values cnl are 1, 2, and 3.

The write control block 56 controls write operation of the display data into the memory block 44. Specifically, the write control block 56 operates in synchronization with DCLK, and receives the display data DATA, as well as the vertical reference signal VS, the horizontal reference signal HS1, and a write reference counter value cnw from the reference signal generation block 50. Then, the write control block 56 generates a write address WADD and a write enable signal WENA on the basis of the write reference counter value cnw. In this embodiment, the write reference counter value cnw is used as WADD as it is. WENA is L level in a WADD valid period. The write control block 56 retards DATA according to the valid periods of WADD and WENA, and outputs DATA as write data WDATA.

The read control block 58 controls read operation of the display data from the memory block 44. Specifically, the read control block 58 operates in synchronization with PCLK, receives the line counter value cnl from the reference signal generation block 50, also receives the horizontal reference signal HS2 and a read reference counter value cnr from the reference signal generation block 52, and generates and outputs read addresses RADD_O and RADD_E. In this embodiment, the read reference counter value cnr is output as the read address RADD_O. On the other hand, (cnr-DL) is output as the read address RADD_E. DL is an arbitrary natural number, and defines the retard amount of readout from the even rows. For example, DL is stored in a register provided within the input signal pre-processing circuit 42.

The read control block 58 latches read data RDATA output from the memory block 44 by PCLK, and outputs the read data RDATA as DATA_R. Also, the read control block 58 generates DTMG_R, which becomes the active period in line with the valid period of DATA_R, on the basis of the read reference counter value cnr.

An input of the address, the write enable, and the clock to an odd row region (memory 60) and an even row region (memory 61) in the memory bank A, as well as an odd row region (memory 62) and an even row region (memory 63) in the memory bank B is switched between write operation and read operation by selectors 64 to 66.

The selectors 64 of the odd row memories 60 and 62 receive WADD and RADD_O, and the selectors 64 of the even row memories 61 and 63 receive WADD and RADD_E. The selectors 65 of the respective memories 60 to 63 receive WENA and the H level, and the selectors 66 receive DCLK and PCLK.

The respective selectors 64 to 66 receive an output signal of the decoder 54 as a changeover control signal. Specifically, the selectors 64 to 66 provided in correspondence with the memory 60 receive lcnt0_p as the changeover control signal, and likewise, the selectors of the memories 61 to 63 receive lcnt1_p, lcnt2_p, and lcnt3_p. The respective selectors output one input for the write operation of the two inputs when the changeover control signal is H level, and output the other input for the read operation when the changeover control signal is L level.

For example, the selector 64 corresponding to the memory 60 selects an input for the write operation in the 1H period where lcnt0_p is H level, and WADD output from the write control block 56 within the 1H period is input to the memory 60. In this situation, the selector 65 inputs WENA to the memory 60, and the selector 66 inputs DCLK to the memory 60, respectively. As a result, WDATA is written in an address of the memory 60 designated by WADD in synchronization with DCLK in a period where WENA is L-level within the 1H period. Likewise, the write operation is conducted in the memories 61 to 63. That is, the display data on a (4n−3)-th row is written into the memory 60, the display data on a (4n−2)-th row is written into the memory 61, the display data on a (4n−1)-th row is written into the memory 62, and the display data on a 4n-th row is written into the memory 63.

The write operation into the respective four memories 60 to 63 is conducted in a 4H cycle. The memory bank A can conduct the read operation in periods other than a period where an access is conducted through the write operation into the memories 60 and 61. The memory bank B can conduct the read operation in periods other than a period where an access is conducted through the write operation into the memories 62 and 63. Specifically, the read operation from the memory bank A is conducted in the 2H period where lcnt2_p or lcnt3_p are H level and then the write operation into the memory bank B is conducted. And the read operation from the memory bank A is conducted in the 2H period where lcnt0_p or lcnt1_p are H level and then the write operation into the memory bank A is conducted.

For example, in the 2H period where the read operation from the memory bank A is conducted, lcnt0_p and lcnt1_p are L level, and the respective selectors 64 to 66 of the memories 60 and 61 are controlled so as to output the input signals for the read operation. When the line counter value cnl is (4n−3), the read control block 58 generates RADD_O and inputs RADD_O to the selector 64 of the memory 60. And, when the line counter value cnl is (4n−2), the read control block 58 generates RADD_E and inputs RADD_E to the selector 64 of the memory 61. As a result, the read data RDATA_O1 is extracted from the memory 60 in a period where the RADD_O is generated in the 2H period, the read data RDATA_E1 is extracted from the memory 61 in a period where the RADD_E is generated in the 2H period, and those read data are input to the read control block 58 as RDATA. The read operation from the memory bank B is conducted in the same manner. The read data RDATA 02 is extracted from the memory 62 when the line counter value cnl is (4n−1), the read data RDATA_E2 is extracted from the memory 63 when the line counter value cnl is 4n, and those read data are input to the read control block 58 as RDATA.

And now, for example, in the read operation from the memory bank A, the read control block 58 starts the output of RADD_O corresponding to the (4n−3)-th row on which the read operation is conducted ahead, in synchronization with a count start of the read reference counter. On the other hand, the read control block 58 starts the output of the RADD_E corresponding to the following (4n−2)-th row from a timing retarded from the count start of the read reference counter by the amount DL. For that reason, a period from the completion of the read operation of the (4n−3)-th row to the completion of the read operation of the (4n−2)-th row is made longer than 1H. Likewise, in the read operation from the memory bank B, a period from the completion of the read operation of the (4n−1)-th row to the completion of the read operation of the 4n-th row is made longer than 1H.

The generation and output of RADD_O and RADD_E from the read control block 58, and the operation of the respective memories 60 to 63 are conducted in synchronization with PCLK at a speed higher than DCLK. As a result, the read operation period of the respective rows is made shorter than the write operation period of the row.

The DATA_R and DTMG_R generated by the read control block 58, and PCLK generated by the reference signal generation block 52 are input to the driver control signal generation block 40 instead of DATA, DTMG, and DCLK input from the image signal source 28. The driver control signal generation block 40 generates DATA_T, the reference clock CL2, the start pulse STH, the data latch pulse CL1, and the AC signal M, which are the output signals to the drain drivers 22, on the basis of those input signals, and also generates the gate start pulse FLM and the gate shift clock CL3, which are the output signals to the gate driver 24. For example, the driver control signal generation block 40 outputs DATA_R as DATA_T, and outputs PCLK as CL2.

Figure 4:
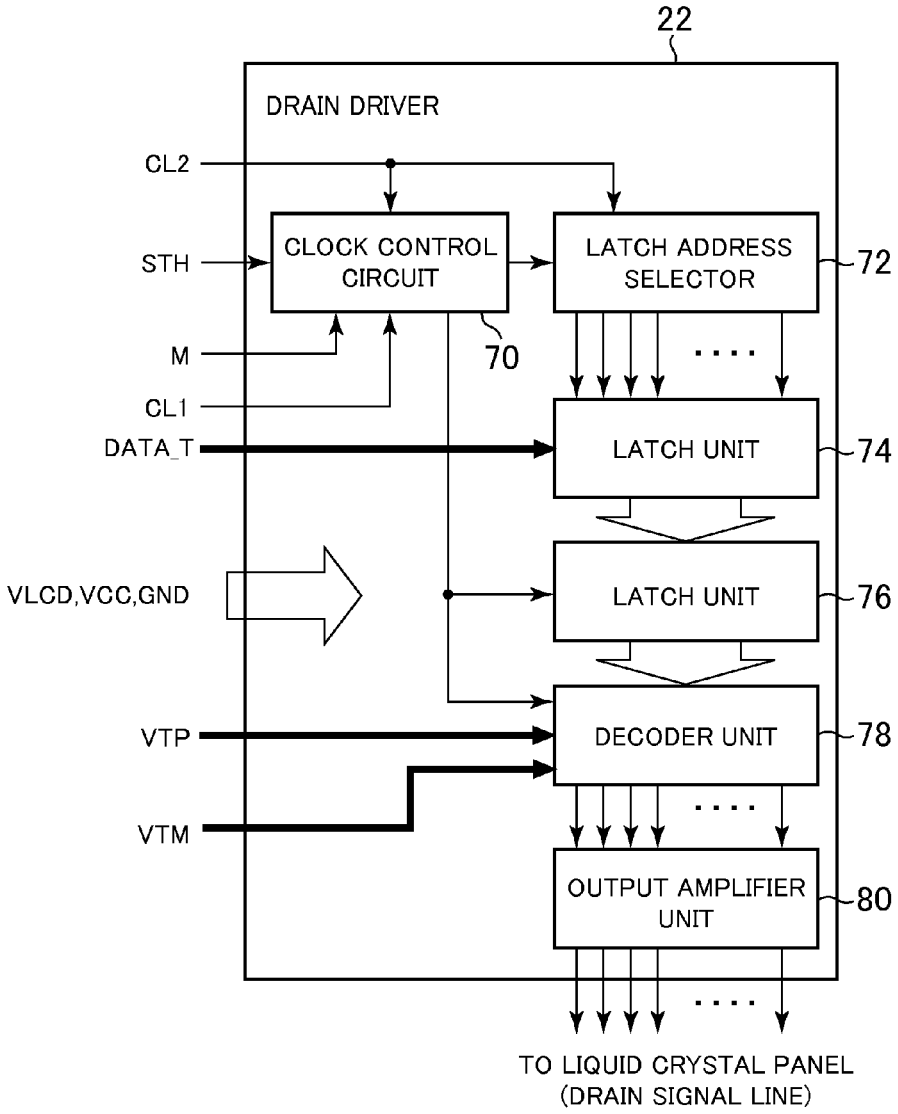
FIG. 4 is a block diagram illustrating a general configuration of a drain driver.

FIG. 4 is a block diagram illustrating a general configuration of the drain driver 22. Each of the drain drivers 22 includes a clock control circuit 70, a latch address selector 72, a pre-stage latch unit 74, a post-stage latch unit 76, a decoder unit 78, and an output amplifier unit 80. The drain driver 22 receives DATA_T, CL2, CL1, and M from the display control circuit 26, and is also applied with, for example, an analog power supply VLCD, a logic power supply VCC, a ground potential GND, a gradation voltage VTP at the time of a positive polarity, and a gradation voltage VTM at the time of a negative polarity, from a power supply circuit. In this embodiment, as described above, DATA_R is input from the display control circuit 26 as DATA_T. The start pulse STH output by the display control circuit 26 is input to one of the drain drivers 22, which is assigned to a head portion of the pixel row. When write of the display data into a certain drain driver 22 has been completed, the start pulse STH is output from the drain driver 22 to the adjacent drain driver 22. Each of the latch units 74 and 76 in each of the drain drivers 22 is configured by latch circuits of the number obtained by multiplying the number of pixel rows allocated to the drain driver 22 by the number of bits of the display data for one pixel. The decoder unit 78 and the output amplifier unit 80 are configured by decoders and output amplifiers of the number equal to the number of pixel rows allocated to each of the drain drivers 22, respectively, and decode the display data of the plurality of pixels aligned in the horizontal direction, in parallel, and can output the video signals to the plurality of the drain signal lines 30 in parallel.

The clock control circuit 70 controls the respective units of the drain driver 22 on the basis of the CL2, STH, CL1, and M.

Upon receiving the start pulse STH, each of the drain drivers 22 starts the operation of the latch address selector 72. For reference, as has been already described, the start pulse STH from the display control circuit 26 is generated at the start timing of the valid period of the display data for one row, and then input to the drain driver 22 that bears the head portion of one row.

Upon starting the operation, the latch address selector 72 generates a data capture signal for the pre-stage latch unit 74 in synchronization with the clock CL2, and outputs the signal to the latch unit 74.

A plurality of latch circuits configuring the pre-stage latch unit 74 is each sequentially designated by the data capture signal output from the latch address selector 72, and latches the display data DATA_R input in synchronization with the clock CL2 from the display control circuit 26 bit by bit.

Upon the completion of the output of the display data for one row, the driver control signal generation block 40 generates the data latch pulse CL1. The clock control circuit 70 of each drain driver 22 makes the post-stage latch unit 76 fetch in the display data latched by the latch unit 74 in synchronization with CL1.

The decoder unit 78 decodes the display data fetched in the latch unit 76, converts the display data into a voltage signal corresponding to the display data, and outputs the voltage signal to the output amplifier unit 80. In this situation, any one of the positive and negative gradation voltages is selected according to a potential of the AC signal M at the timing of the pulse of CL1, and the decoder unit 78 outputs a voltage corresponding to the display data among the gradation voltages of the selected polarity. For reference, the AC signal M inverts the level in the 2H cycle within one frame period in correspondence with the two-line inversion driving, and is the same level between the timing of CL1 for the (2n−1)-th row, and the timing of CL1 for the 2n-th row. The level of the AC signal M on the same row is inverted every one frame.

The output amplifier unit 80 current-amplifies the input voltage, and outputs the voltage to the corresponding drain signal line 30.

Figure 5:
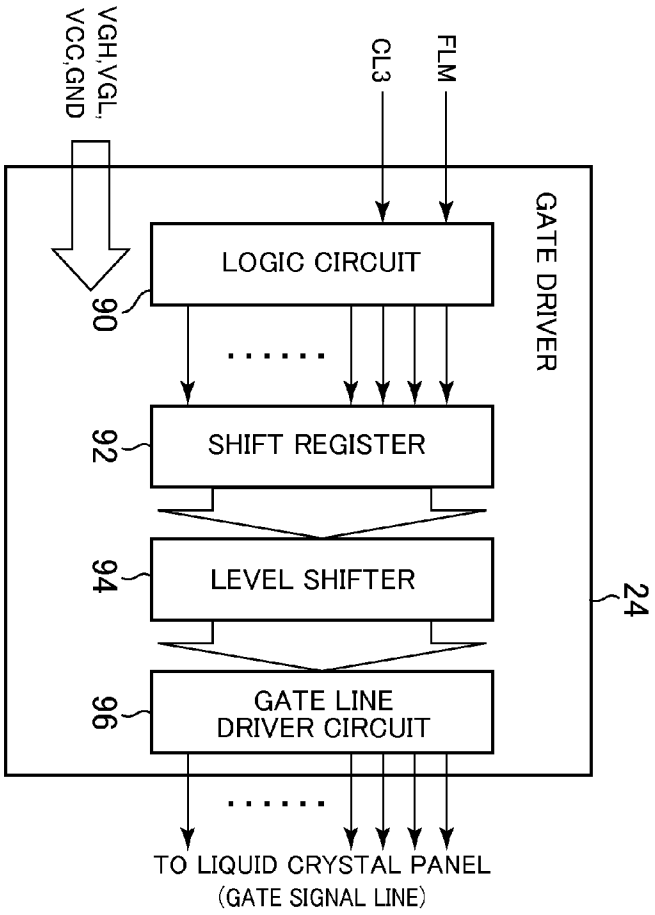
FIG. 5 is a block diagram illustrating a general configuration of a gate driver.

FIG. 5 is a block diagram illustrating a general configuration of the gate driver 24. The gate driver 24 includes a logic circuit 90, a shift register 92, a level shifter 94, and a gate line driver circuit 96. The gate driver 24 receives FLM and CL3 from the display control circuit 26, and also is applied with, for example, a gate voltage VGH that turns on the TFT, a gate voltage VGL that turns off the TFT, a logic power supply VCC, and a ground potential GND from the power supply circuit.

The display control circuit 26 generates the gate start pulse FLM which is a control signal for ordering a scanning start from a first row of one frame, and generates the gate shift clock CL3 which is a control signal for ordering the changeover of the rows (gate signal lines 32) to be scanned. The logic circuit 90 starts the operation of the shift register 92 in synchronization with CL3 input within a pulse width of FLM. The shift register 92 outputs a pulse to the output terminal of a head stage in correspondence with the output period of the video signal on the first row in synchronization with CL3 within the pulse width of FLM. The logic circuit 90 advances the operation of the shift register 92 step after step every time CL3 is input.

The pulses output from output terminals of plural stages of the shift register 92 in turn are input to the level shifter 94. The level shifter 94 converts the input pulse into a voltage suitable for the drive of the gate line driver circuit 96. Upon receiving the pulses from the level shifter 94, the gate line driver circuit 96 applies a voltage VGH to the corresponding gate signal line 32. As a result, the TFTs of the pixels of the row to be scanned which is selected in turn by the shift register 92 turn on, and the video signals output to the drain signal lines 30 are written into the pixel electrodes. On the other hand, the gate line driver circuit 96 applies the voltage VGL to the gate signal lines 32 other than the row to be scanned, and keeps the TFTs of the pixels off.

Subsequently, a description will be given of the write of the video signals into the pixel electrodes which is realized by the above-mentioned display control circuit 26 with reference to FIGS. 6 and 7.

Figure 6:
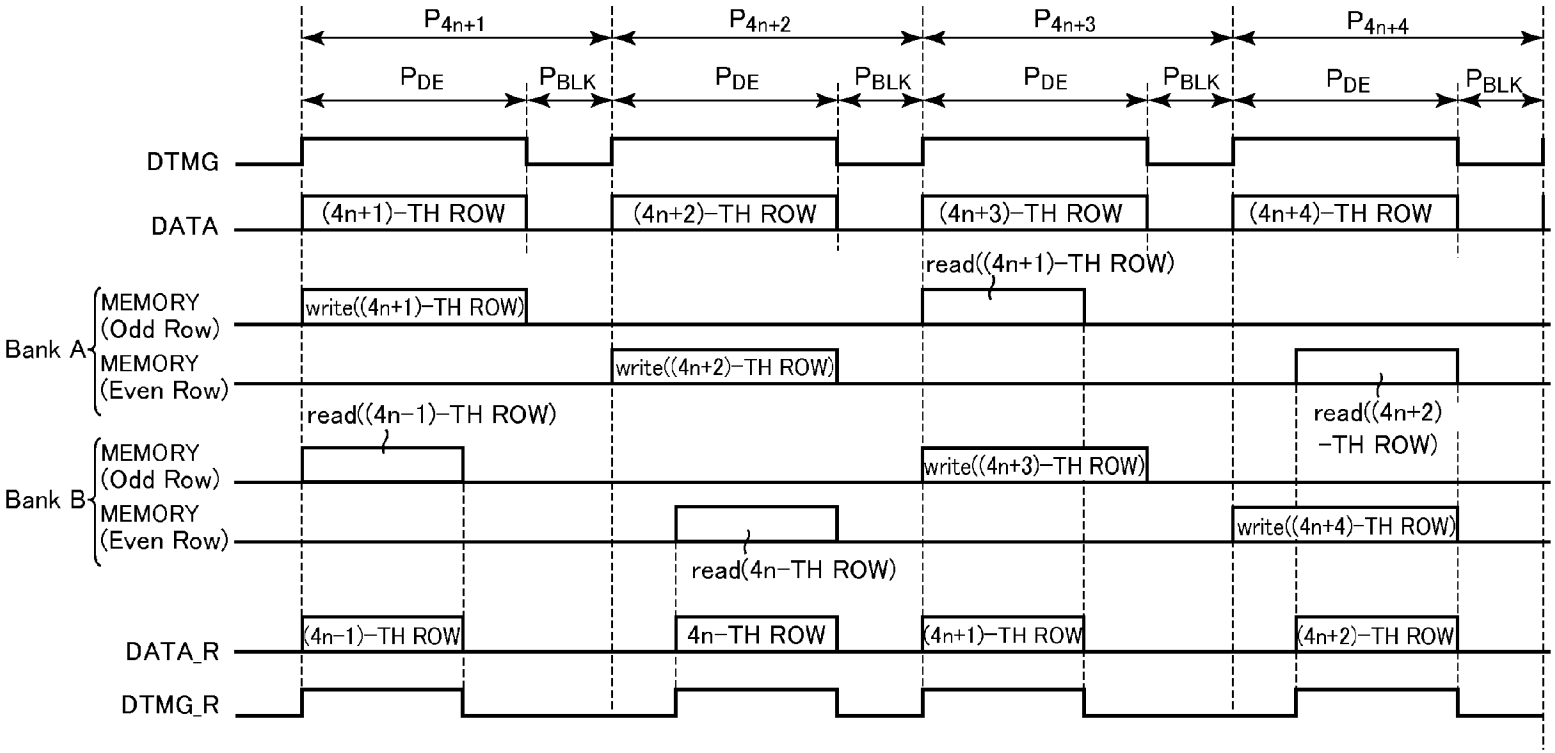
FIG. 6 is a schematic timing chart illustrating write operation and read operation of a memory in an input signal pre-processing circuit.

FIG. 6 is a schematic timing chart illustrating the write operation and the read operation of the memory in the input signal pre-processing circuit 42. FIG. 6 illustrates the write operation and the read operation of the memory in periods $P_{4n+1}$ to $P_{4n+4}$ where the display data of the (4n+1)-th to (4n+4)-th rows is input to the display control circuit 26. In this example, the periods $P_{4n+1}$ to $P_{4n+4}$ each represent a length of 1H corresponding to the horizontal scanning period.

An active period $P_{DE}$ of DTMG input from the image signal source 28 to the display control circuit 26, and a horizontal blanking period $P_{BLK}$ which is a period interposed between the active periods $P_{DE}$ are kept constant on each row. The valid period of DATA matches the active period $P_{DE}$, and similarly is kept constant not depending on the rows.

The display data of the (4n+1)-th row is written into the memory 60 corresponding to the odd rows in the memory bank A in synchronization with the input of DATA by serial transmission in the period $P_{4n+1}$. Hence, the write operation is conducted with the same time length $\tau_{DE}$ as the active period $P_{DE}$ from a head of the period $P_{4n+1}$. Likewise, DATA of the (4n+2)-th to (4n+4)-th rows are input in the periods $P_{4n+2}$ to $P_{4n+4}$ in synchronization with the active period $P_{DE}$. Specifically, the (4n+2)-th row is written in the memory 61 corresponding to the even rows of the memory bank A, the (4n+3)-th row is written in the memory 62 corresponding to the add rows of the memory bank B, and the (4n+4)-th row is written in the memory 63 corresponding to the even rows of the memory bank B.

The write operation into both of those memory banks is alternately conducted in the 2H period, and the read operation from each memory bank is conducted in the 2H period in which the write operation is not conducted in the memory bank. Specifically, the display data of the (4n+1)-th row and the (4n+2)-th row which are written in the memory bank A in the periods $P_{4n+1}$ and $P_{4n+2}$ is read out as DATA_R in the periods $P_{4n+3}$ and $P_{4n+4}$ which are the time until the storage contents are updated in the subsequent write operation. Likewise, the display data of the (4n−1)-th row and the 4n-th row, which are written in the memory bank B in the periods $P_{4n-1}$ and $P_{4n}$ are read out in the periods $P_{4n+1}$ and $P_{4n+2}$ as DATA_R.

As has been already described, the read control block 58 sets the period $\zeta_O$ from the completion of the read operation of the odd row to the completion of the read operation of the even row to be longer than 1H for a pair of rows in which the video signals are produced with the same polarity. On the other hand, the period $\zeta_E$ from the read operation completion of the even row to the read operation completion of the subsequent odd row is reduced, and set to be shorter than 1H as much as the increased length of the period $\zeta_O$. As a result, the output period of the video signals to the drain signal lines 30 for the odd row scanned in advance after the polarity inversion in the two-line inversion driving is set to be longer than that of the even row to be subsequently scanned, to thereby compensate a difference in the substantial write period occurring between the odd row which is the preceding scanning row and the even row which is the following scanning row, which is attributable to a retard of the rising of the video signal after the polarity inversion.

The period $\zeta_O$ is enlarged by any one or both of advancing the read operation completion timing of the preceding scanning row, and retarding the read operation completion timing of the following scanning row. In this example, even if the read operation is conducted with the same time $\tau_{DE}$ as that of the write operation by setting the frequency of PCLK equal to the frequency of DCLK in the display control circuit 26, the read operation completion timing of the following scanning row can be retarded up to the completion of the horizontal blanking period $P_{BLK}$. As a result, the period $\zeta_O$ can be enlarged by the time length $E_{BLK}$ of the horizontal blanking period $P_{BLK}$ at the maximum. In this embodiment, PCLK is set to be higher in speed than DCLK, and the time length $\tau_{DE-R}$ of the read operation is made shorter than $\tau_{DE}$, thereby being capable of advancing the read operation completion timing of the preceding scanning row, and further enlarging the period $\zeta_O$. As a result, the effect of compensating the substantial write time difference between the preceding scanning row and the following scanning row described above is improved.

The display control circuit 26 controls the amount of enlargement of the period $\zeta_O$ from the 1H period by the retard amount $\tau_{DL}$ of the start timing of the valid period of the DATA_R in the even row. Specifically, as has already been described, the read control block 58 outputs the read reference counter value cnr as the read address RADD_O of the odd row while outputting (cnr-DL) as the read address RADD_E of the even row and thereby, the retard amount $\tau_{DL}$ is set. For reference, the retard amount $\tau_{DL}$ is a time length obtained by multiplying a cycle of PCLK by DL, $\zeta_O$ is $(1H+\tau_{DL})$, and $\zeta_E$ is $(1H-\tau_{DL})$.

Figure 7:
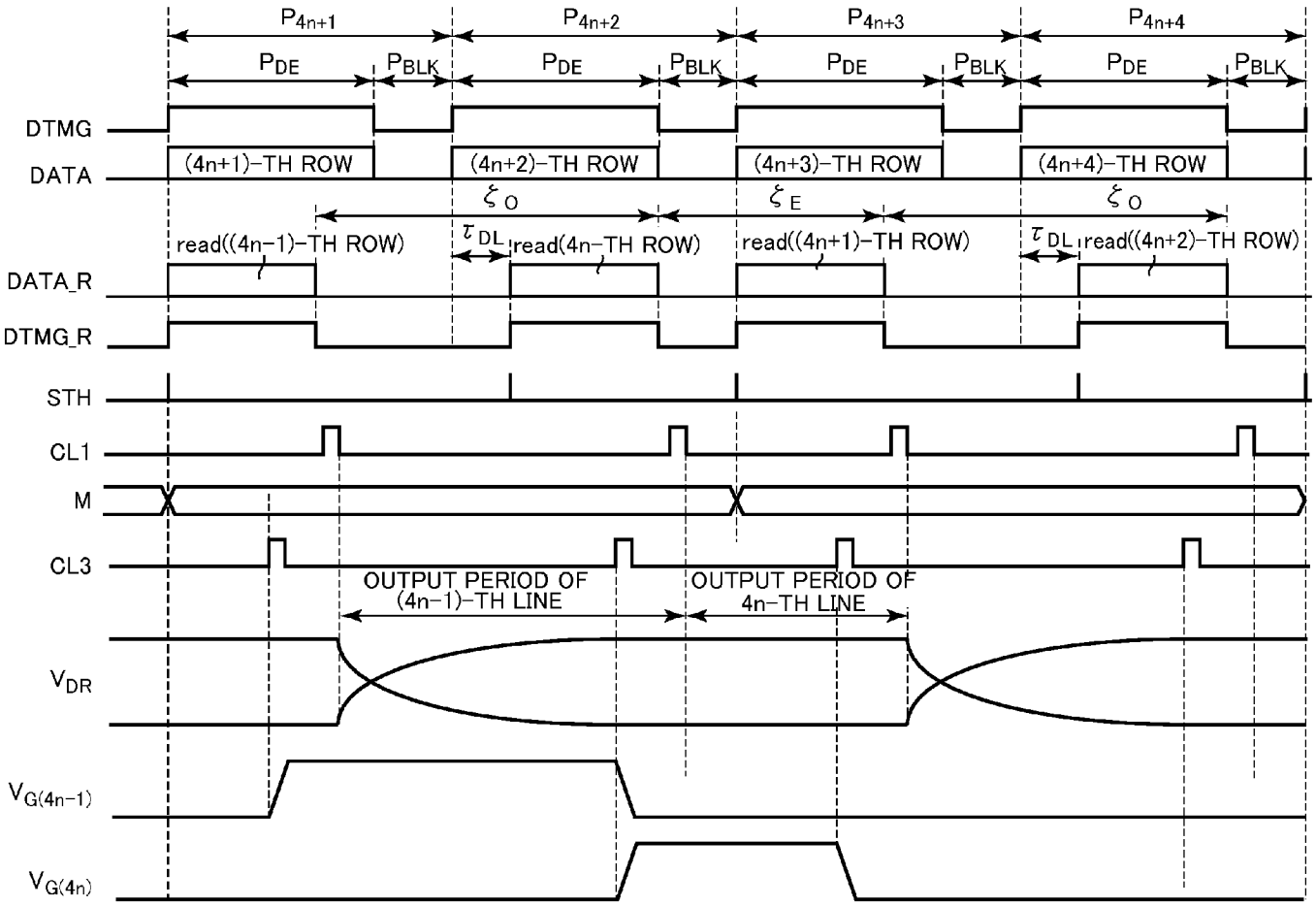
FIG. 7 is a schematic timing chart of input and output signals of the display control circuit, and potential changes in drain signal lines and gate signal lines.
Figure 8:
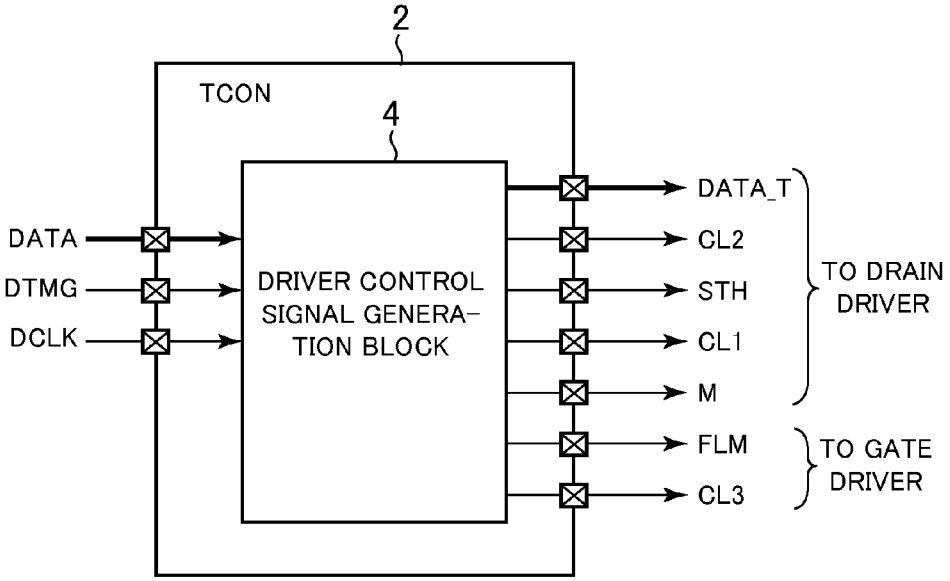
FIG. 8 is a block diagram of a related-art display control circuit that controls the drive of a liquid crystal display panel.
Figure 9:
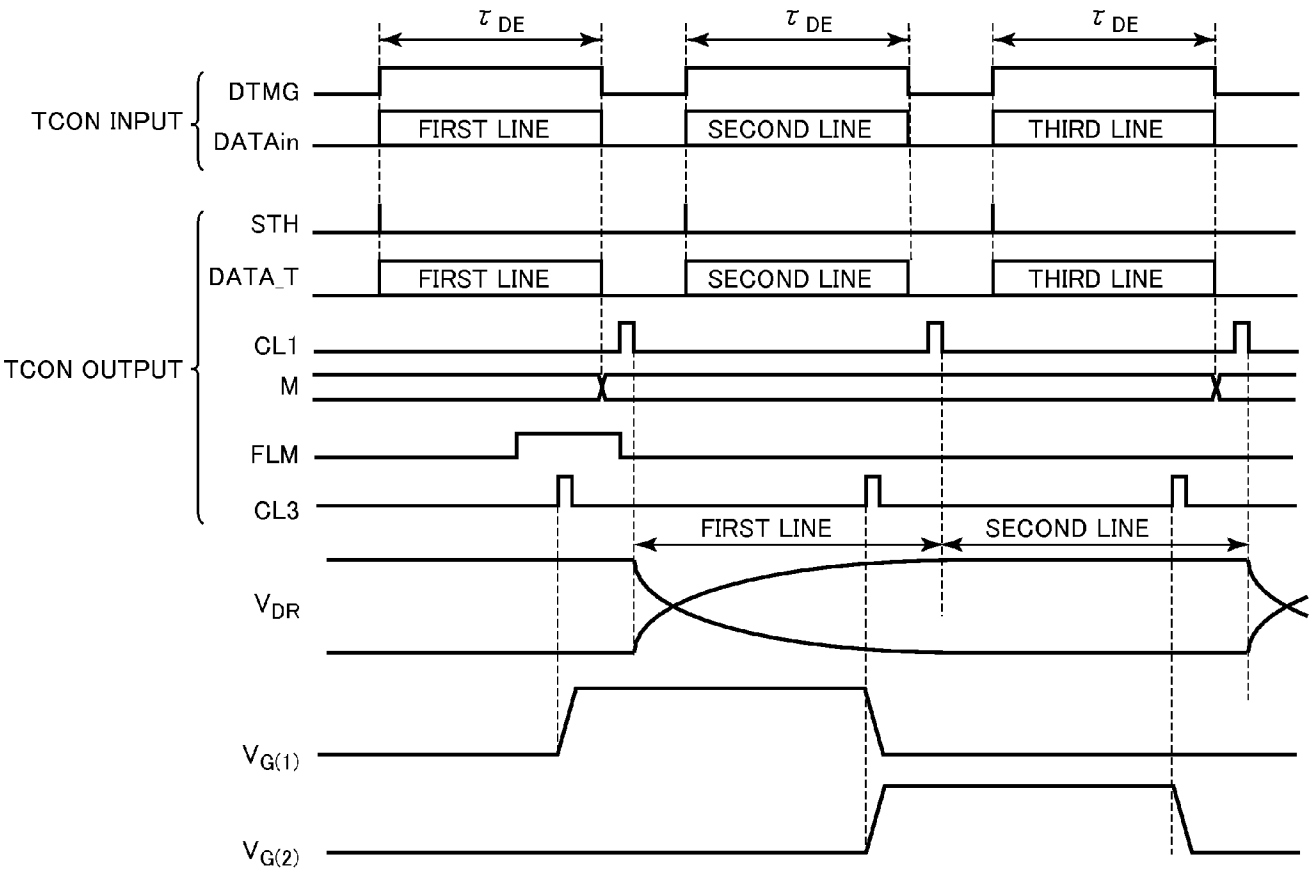
FIG. 9 is a timing chart of input and output signals of the related-art display control circuit, and potentials of the drain signal lines and the gate signal lines.

FIG. 7 is a schematic timing chart of input and output signals of the display control circuit 26, and potential changes in drain signal lines and gate signal lines. In FIG. 7, DCLK among the signals input to the display control circuit 26 is omitted, and CL2 and FLM among the signals output from the display control circuit 26 are omitted.

The driver control signal generation block 40 receives DATA_R, DTMG_R, and PCLK, and generates the reference clock CL2, the start pulse STH, the data latch pulse CL1, and the AC signal M to output those signals to the drain driver 22 on the basis of those signal, and also generates the gate start pulse FLM and the gate shift clock CL3 to output those signals to the gate driver 24.

Specifically, the start pulse STH is generated so that the falling edge of STH is synchronized with the rising edge of DTMG_R. The read operation from the memory block 44 is started in synchronization with the falling edge of the start pulse STH, and the read display data is serially transmitted to the drain drivers 22.

The data latch pulse CL1 is generated with reference to the falling timing of DTMG_R. That is, when the write of the display data for one row into the pre-stage latch unit 74 has been completed in synchronization with the read operation, the data latch pulse CL1 is generated. The post-stage latch unit 76 in each of the drain drivers 22 captures the display data held by the pre-stage latch unit 74 in synchronization with the falling of the CL1 all together. The decoder unit 78 and the output amplifier unit 80 generate the video signals on the basis of the display data, and supply the video signals to the drain signal lines 30. That is, CL1 determines the start timing of the output period of the video signals for each of the rows, and the pulse interval of CL1 is an output period of the video signals for each of the rows.

Since CL1 is generated in synchronization with the falling of DTMG_R, a length of the output period of the video signal in the odd row is $\zeta_O$, that is, $(1H+\tau_{DL})$, and a length of the output period of the video signal in the even row is $\zeta_E$, that is, $(1H-\tau_{DL})$.

As has already been described, the level of the AC signal M is inverted in the 2H period, the same level is obtained at the timing of CL1 in the (2n−1)-th row and the timing of CL1 in the 2n-th row. The level of the AC signal M in the same rows is inverted every one frame.

In the 2-line inversion driving, a voltage of the video signal output from the drain driver 22 and the voltage $V_{DR}$ of the drain signal line 30 have opposite polarities to each other when the output period of the video signal in the odd row starts, and therefore a voltage difference between those voltages is larger than the voltage difference when the output period of the video signal in the even row starts. For that reason, the rising retard time which is a time until the drain signal lines 30 arrive at the voltage corresponding to the output of the drain drivers 22 at the odd row is longer than at the even row. On this point, the display control circuit 26 controls the output periods of the respective rows so that $\zeta_O>\zeta_E$ is satisfied as described above whereby the voltage $V_{DR}$ across the drain signal lines 30 in the odd row can arrive at the level corresponding to the video signal as with the even row. FIG. 7 illustrates potential changes in both the polarities of $V_{DR}$ in correspondence with the inversion of the AC signal M for each of the frames.

The gate shift clock CL3 is generated in the same cycle as that of CL1, and the gate driver 24 rises the gate pulse to the gate signal lines 32 of the row to be scanned in synchronization with the rising of CL3, and falls the gate pulse to the gate signal lines 32 of the row scanned ahead. The pixel electrodes of the pixels in the row to be scanned are connected to the drain signal lines 30, and charged with the voltage corresponding to the video signal while the TFTs are kept on by the application of the gate pulse. And, when the gate pulse falls and the TFTs turn off, the pixel electrodes hold the voltage at that time. Hence, a phase of CL3 relative to CL1 is set so that the end timing of an on-period of the TFTs is before the start of the output period of the video signal of the subsequent row to be scanned.

The above-mentioned liquid crystal display device 10 compensates a difference in the substantial write period between the two rows into which the video signals are written with the same polarity in the two-line inversion driving by setting $\zeta_O$ to $(1H+\tau_{DL})$ and $\zeta_E$ to $(1H-\tau_{DL})$, and can improve the image quality with the elimination or reduction of the lateral stripes. $\tau_{DL}$ which is an adjustment time of the output period of the video signal is set to preferably obtain the above advantages. For example, a time until the potential of the drain signal lines 30 is stabilized when the video signal voltage from the drain drivers 2 is switched to another becomes longer as a parasitic capacity or resistance of the drain signal lines 30 is larger. On the other hand, the time becomes shorter as the a current drive capability of the drain drivers 22 is larger. Hence, a time constant of the potential change in the drain signal lines 30 can be calculated taking the above into consideration, and the $\tau_{DL}$ can be designed on the basis of the time constant. When the input signal pre-processing circuit 42 is configured to make the frequency of PCLK and the retard amount $\tau_{DL}$ variable, the $\tau_{DL}$ can be appropriately adjusted so that the image quality is preferable.

In particular, in the liquid crystal display device 10 according to this embodiment, the drain drivers 22 are supplied with the video signal from only one end of the drain signal lines 30. For that reason, a change in the output voltage of the drain drivers 22 becomes decreased more toward a position more away from the drain drivers 22 on the drain signal lines 30. That is, the retard of the rising of the video signal after the polarity inversion in the two-line inversion driving can be larger as the pixel row is farther from the drain drivers 22.

To cope with the above problem, the input signal pre-processing circuit 42 can be configured to increase the extension period $\tau_{DL}$ of $\zeta_O$ according to a distance of the drain signal lines 30 from the drain drivers 22 to the preceding scanning row, for each of the pixel row pair including the preceding scanning row and the following scanning row which are adjacent to each other and supplied with the video signals of the same polarity. For example, when the scanning operation is conducted in order from the pixel row closer to the drain driver 22, the input signal pre-processing circuit 42 can be configured to count the number of scanning rows from the head of the frame, and increment DL set in the register of the read control block 58 by a predetermined natural number, every pixel row pair driven by the two-line inversion driving with the same polarity, or every predetermined plural pixel row pairs. Also, there is a configuration in which the input signal pre-processing circuit 42 includes a memory that stores a table of the DL set within one frame. In this configuration, DL increased according to a distance of the scanning row from the drain drivers 22 is stored in the memory in an address order in advance, and the input signal pre-processing circuit 42 generates RADD_E with the use of the DL read out from the address corresponding to a count value of the number of scanning rows.

The above-mentioned liquid crystal display device 10 can compensate the substantially write time difference between the odd rows and the even rows with the addition of the input signal pre-processing circuit 42 while the driver control signal generation block 40 has the same configuration as that of the related art. In this configuration, since the related-art driver control signal generation block can be used, the circuit design of the overall display control circuit 26 is facilitated. Also, in the liquid crystal display device installed with the related-art display control circuit 2 having the driver control signal generation block 4, the above-mentioned substantial write time difference can be compensated with the addition of the input signal pre-processing circuit 42 as an interface circuit between the image signal source and the display control circuit 2.

Modified Example

On the other hand, the display control circuit that compensates the above-mentioned substantial write time difference can be configured without the use of the related-art driver control signal generation block. Hereinafter, an example of this configuration will be described.

(1) In the above-mentioned embodiment, a start of the reduced write period for writing the display data of the even row into the latch unit 74 is retarded, as a result of which the timing of the data latch pulse CL1 synchronized with the write completion is set. In regard to this point, even in a configuration in which the start of the reduced write period for writing the display data of the even row into the latch unit 74 is not retarded, but a retard time since the write completion till the data latch pulse CL1 is set, the output period of the video signal to the odd row can be made longer than 1H.

(2) In the above-mentioned embodiment, the write period for writing the display data into the latch unit 74 is reduced in both of the odd rows and the even rows. In regard to this point, even in a configuration in which the write period is shortened to advance the timing of the data latch pulse CL1 in the odd row as in the above-mentioned embodiment whereas the write period is not shortened in the even row, the output period of the video signal to the odd row can be made longer than 1H. In this configuration, the write period or CL1 of the even row may not be retarded, or can be retarded within a range of the time length $\tau_{BLK}$ of the horizontal blanking period $P_{BLK}$.

As has been described above, according to the present invention described in the embodiment, the output period of the video signals to the video signal lines for each of the preceding scanning row and the following scanning row, which are a pair of pixel rows scanned by the two-line inversion driving with the same polarity is reduced in the following scanning row, but enlarged in the preceding scanning row. As a result, the difference in the substantial write period between the preceding scanning row and the following scanning row can be compensated to improve the image quality with the elimination or reduction of the lateral stripes.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device, comprising:

a plurality of pixels which is arranged in a matrix;

a plurality of video signal lines which is provided in correspondence with a plurality of pixel columns, and supplies video signals to the pixels;

a plurality of scanning signal lines which is provided in correspondence with a plurality of pixel rows, and is supplied in turn with scanning signals for selecting a scanning row to which the video signals are supplied among the pixel rows;

a video signal line driver circuit into which the display data corresponding to one of the pixel rows is written, and which generates the video signal on the basis of the display data and outputs the video signals to the plurality of video signal lines in parallel when an output timing signal is input to the video signal line driver circuit; and a display control circuit that receives the display data from an external by serial transmission, outputs the display data and the output timing signal to the video signal line driver circuit, and performs line inversion driving of the pixels every two rows, wherein the display control circuit writes the display data into the video signal line driver circuit on at least a preceding scanning row of a pair of the pixel rows which are adjacent to each other and supplied with the video signals of the same polarity, at a speed higher than a transmission speed from the external, and sets an output period of the video signals on the preceding scanning row to be longer than an output period of the video signals on a following pixel row of the preceding scanning row, the output period for each of the pixel rows being determined according to a cycle of the output timing signal.

2. A liquid crystal display device, comprising:

a control signal generator circuit that receives display data corresponding to a plurality of pixels arranged in a matrix, and a data enable signal which is rendered active in a valid data period of each of pixel rows, conducts a drive control for writing video signals corresponding to the display data into the respective pixels in synchronization with the data enable signal, and performs line inversion driving of the pixels every two rows;

a video signal line driver circuit into which the display data corresponding to one of the pixel rows is written in an active period of the data enable signal under the drive control, and which generates the video signals on the basis of the display data, and outputs the video signals to a plurality of video signal lines provided in correspondence with a plurality of the pixel columns in parallel; and an input signal pre-processing circuit that receives the display data and an original data enable signal from an external of the liquid crystal display device, generates a modified data enable signal having an active period reduced more than an active period of the original data enable signal, and inputs the modified data enable signal to the control signal generator circuit as the data enable signal, the input signal pre-processing circuit, in the active period of the modified data enable signal, reading out the display data of the respective pixel rows stored in a buffer at a speed higher than that when being input from the external and inputting the display data to the control signal generator circuit, wherein the modified data enable signal has an interval of the active period between a preceding scanning row and a following scanning row, which are a pair of the pixel rows adjacent to each other and supplied with the video signals of the same polarity set to be larger than an interval of the active period between the following scanning row and a row subsequent to the following scanning row.

3. The liquid crystal display device according to claim 2, wherein the input signal pre-processing circuit includes two memory banks as the buffer, each of which can store the respective display data of the pair of pixel rows, wherein the input signal pre-processing circuit sequentially writes the display data of the pair of pixel rows, which are adjacent to each other and supplied with the video signals of the same polarity, in the memory banks in synchronization with the original data enable signal, and wherein the input signal pre-processing circuit reads out the display data written into one of the memory banks in synchronization with the modified data enable signal, and inputs the display data to the control signal generator circuit, while writing the display data into the other memory bank.

4. The liquid crystal display device according to claim 2, wherein the input signal pre-processing circuit sets an interval of an active period of the modified data enable signal between the preceding scanning row and the following scanning row to a period obtained by adding an extension period to a horizontal scanning period given in a cycle of the original data enable signal, for each of a pixel row pair which is adjacent to each other and supplied with the video signal of the same polarity, and increases the extension period according to a distance of the video signal line between the video signal line driver circuit and the preceding scanning row.

5. A liquid crystal display device, comprising:

a plurality of pixels which are arranged in a matrix, and each have a pixel electrode and a common electrode;

a plurality of video signal lines that supplies video signals to the pixels;

a plurality of scanning signal lines, each of which supplies scanning signals to the pixels corresponding to the scanning signal line during one scanning period;

a video signal line driver circuit that outputs the video signals to the plurality of video signal lines; and a display control circuit that receives display data from an external by serial transmission, and outputs display data and output timing signals to the video signal line driver circuit, wherein a reference voltage is applied to the common electrode, wherein the video signal line driver circuit outputs the video signals that invert the polarity relative to the reference voltage for two scanning periods, wherein a preceding first scanning period of two scanning periods in which the video signals of the same polarity are output is longer than a following second scanning period, wherein the display control circuit outputs first display data corresponding to the video signal output during the first scanning period, and second display data corresponding to the video signal output during the second scanning period to the video signal line driver circuit, and wherein a second period from an output completion of the second display data to an output completion of the first display data is shorter than a first period from the output completion of the first display data to the output completion of the second display data.

6. The liquid crystal display device according to claim 5, wherein the display control circuit retards a timing at which the second display data starts to be output, and makes the second period shorter than the first period.

7. The liquid crystal display device according to claim 5, wherein the display control circuit outputs a start signal indicative of a start of the scanning period, and changes an interval at which the start signal is output to make the first scanning period longer than the second scanning period.

8. The liquid crystal display device according to claim 5, wherein the display control circuit includes a pair of memory banks, reads display data corresponding to the video signal of a first polarity into a first memory bank, and reads display data corresponding to the video signal of a second polarity into a second memory bank.

9. The liquid crystal display device according to claim 5, wherein a difference between the first scanning period and the second scanning period is increased according to a distance of the video signal lines from the video signal line driver circuit to the pixels to which the video signals are supplied.

* * * * *